US010285437B2

(12) United States Patent
Russell

(10) Patent No.: US 10,285,437 B2
(45) Date of Patent: May 14, 2019

(54) ATTACHMENT DEVICE FOR HAND-HELD VAPORIZER

(71) Applicant: Tamatha Lagina Russell, Ray, MI (US)

(72) Inventor: Tamatha Lagina Russell, Ray, MI (US)

( * ) Notice: Subject to any disclaimer, the term of this patent is extended or adjusted under 35 U.S.C. 154(b) by 0 days.

(21) Appl. No.: 15/684,696

(22) Filed: Aug. 23, 2017

(65) Prior Publication Data

US 2018/0055089 A1 Mar. 1, 2018

Related U.S. Application Data

(60) Provisional application No. 62/434,831, filed on Dec. 15, 2016, provisional application No. 62/379,620, filed on Aug. 25, 2016.

(51) Int. Cl.

| | |
|---|---|
| ***A24F 13/00*** | (2006.01) |
| ***A24F 9/00*** | (2006.01) |
| ***A24F 47/00*** | (2006.01) |

(52) U.S. Cl.

CPC ..... *A24F 9/00* (2013.01); *A24F 47/008* (2013.01)

(58) Field of Classification Search

CPC ..... A24F 47/008

USPC ..... 131/328–329

See application file for complete search history.

(56) References Cited

U.S. PATENT DOCUMENTS

| | | | | |
|---|---|---|---|---|
| 2013/0239982 | A1* | 9/2013 | Meyer | A24F 13/12 131/328 |
| 2014/0318557 | A1* | 10/2014 | Bremer | A24F 1/00 131/328 |
| 2016/0165955 | A1* | 6/2016 | Horne | A45F 5/02 131/328 |

* cited by examiner

*Primary Examiner* — Phuong K Dinh

(74) *Attorney, Agent, or Firm* — Larry E. Henneman, Jr.; Henneman & Associates, PLC

(57) ABSTRACT

A handheld vaporizer attachment device includes a finger engaging feature and a first coupling feature that frictionally engages the handheld vaporizer at a first joint between vaporizer components. The attachment device can further include a second coupling feature that attaches over the mouthpiece of the vaporizer or frictionally engages the vaporizer at a second joint between vaporizer components. In another example, the finger engaging feature includes an annular member held in place by a strap disposed between two coupling features. The attachment feature can be monolithically formed.

35 Claims, 16 Drawing Sheets

ATTACHMENT DEVICE FOR HAND-HELD VAPORIZER

CROSS-REFERENCE TO RELATED APPLICATIONS

This application claims the benefit of U.S. Provisional Patent Application Ser. No. 62/379,620, filed on Aug. 25, 2016 by at least one common inventor and entitled "ATTACHMENT DEVICE FOR HAND-HELD VAPORIZER," which is incorporated by reference herein in its entirety. This application also claims the benefit of U.S. Provisional Patent Application Ser. No. 62/434,831, filed on Dec. 15, 2016 by at least one common inventor and entitled "ATTACHMENT DEVICE FOR HAND-HELD VAPORIZER," which is incorporated by reference herein in its entirety.

BACKGROUND OF THE INVENTION

Field of the Invention

This invention relates generally to electronic handheld vaporizers, and more particularly to devices for attachment to electronic handheld vaporizers.

Description of the Background Art

Electronic handheld vaporizers (e.g., electronic cigarettes) are becoming an increasingly popular alternative to traditional smoking. Typically, handheld vaporizers include a battery unit, a vaporizing unit, a mouthpiece unit, and control circuitry. The battery unit includes a rechargeable battery that supplies power to an atomizer (e.g., a heating element) located in the vaporizing unit. The battery unit is mechanically and electrically coupled to one end of the vaporizing unit while the mouthpiece is mechanically coupled to the opposite end of the vaporizing unit. The vaporizing unit also includes a fluid reservoir where flavored fluid is stored before being vaporized by the heating element. The mouthpiece is typically attached to the opposite end of the vaporizing unit so that the user can inhale the vapor generated by the heating element. The control circuitry determines when to actuate the heating element according to user input. For example, in some vaporizers, the control circuitry includes a simple switch that, when pressed, allows power to be supplied to the heating element.

One common problem with such handheld vaporizers is that they are easily dropped, which may cause damage or inoperability to the unit. They may also fall out of pockets easily, becoming damaged or lost. Unfortunately, handheld vaporizers are relatively complex and, therefore, expensive to replace.

SUMMARY

The present invention overcomes the problems associated with the prior art by providing an attachment device for an electronic handheld vaporizer. The attachment device provides a handle portion for holding and securing the handheld vaporizer to prevent accidental drops and the associated damage to the vaporizer.

According to an embodiment of the invention, an attachment device for an electronic handheld vaporizer includes a finger engaging feature adapted to engage at least one finger of a user and a first coupling feature disposed to couple the attachment device to the handheld vaporizer.

In a particular embodiment, the first coupling feature includes a first planar surface defining an aperture passing therethrough, where the aperture is adapted to receive a portion of at least one of a battery unit, a vaporizing unit, and a mouthpiece unit of the handheld vaporizer therethrough. In a more particular embodiment, the first planar surface is adapted to frictionally engage the vaporizing unit of the handheld vaporizer. In an even more particular embodiment, the first coupling feature includes a second planar surface opposite the first planar surface, where the aperture passes through the second planar surface, and the second planar surface is adapted to frictionally engage the battery unit of the handheld vaporizer. Optionally, the second planar surface is adapted to frictionally engage the mouthpiece unit of the handheld vaporizer.

In another particular embodiment, the attachment device further includes a second coupling feature disposed to couple the attachment device to the handheld vaporizer. The first coupling feature is disposed at a first end of the finger engaging feature, and the second coupling feature is disposed at a second end of the finger engaging feature.

In a more particular embodiment, the first coupling feature is adapted to frictionally engage a battery unit of the handheld vaporizer. Still more particularly, the second coupling feature is adapted to engage a mouthpiece unit and/or a vaporizing unit of the handheld vaporizer. Where the second coupling feature is adapted to engage the vaporizing unit, the first coupling feature is adapted to frictionally engage both the battery unit and the vaporizing unit of the handheld vaporizer, and the second coupling feature is adapted to frictionally engage both a mouthpiece unit and the vaporizing unit of the handheld vaporizer. In still an even more particular embodiment, the first coupling feature is generally planar and defines a first aperture passing therethrough, the second coupling feature is also generally planar and defines a second aperture passing therethrough, and the first and second apertures are coaxially aligned with respect to one another when the attachment device is attached to the handheld vaporizer.

In another more particular embodiment, the first coupling feature is generally planar and includes a top surface, a bottom surface, and an aperture passing through the top surface and the bottom surface. Similarly, the second coupling feature is generally planar and includes a top surface, a bottom surface, and an aperture passing through the top surface and the bottom surface of the second coupling feature. Additionally, the top surface of the first coupling feature and the bottom surface of the second coupling feature are adapted to engage one another, and the aperture of the first coupling feature and the aperture of the second coupling feature are coaxially aligned with respect to one another when the top surface of the first coupling feature engages the bottom surface of the second coupling feature. Optionally, the attachment device includes a generally annular member having an inner surface adapted to engage a finger and an outer surface. Additionally, the finger engaging feature includes a strap having a first end coupled to the first coupling feature and a second end coupled to the second coupling feature such that the strap is configured to secure the annular member. The outer surface of the generally annular member can optionally define a channel configured to receive the strap therein.

Still other particular embodiments are also disclosed. In one, the attachment device includes a utility clip. In another, the finger engaging feature and the first coupling feature are integrally formed. In still another, the attachment device further includes instructions explaining to a user how to attach the attachment device to the handheld vaporizer and/or how to use the attachment device.

An electronic handheld vaporizer according to an embodiment of the invention includes a battery unit, a vaporizing unit adapted to couple with the battery unit, a mouthpiece unit adapted to couple with the vaporizing unit, and an attachment device having a handle portion and at least one coupling mechanism. The handle portion is configured to engage at least one finger of a user. Additionally, the at least one coupling mechanism is disposed to couple the attachment device to the handheld vaporizer such that the handle portion is disposed adjacent to at least one of the battery unit, the vaporizing unit, and the mouthpiece unit.

A method of manufacturing an attachment device configured to engage a handheld vaporizer is also described. The method includes forming a finger engaging feature and forming a first coupling feature. The finger engaging feature is adapted to engage at least one finger of a user. The first coupling feature is disposed to couple the attachment device to the handheld vaporizer. A particular method further comprises a step of forming a second coupling feature disposed to couple the attachment device to the handheld vaporizer, where the first coupling feature is formed at a first end of the finger engaging feature and the second coupling feature is formed at a second end of the finger engaging feature. Even more particularly, the step of forming the finger engaging feature includes providing a strap and a generally annular member. The strap has a first end coupled to the first coupling feature and a second end coupled to the second coupling feature. Additionally, the generally-annular member has an inner surface adapted to engage at least one finger of the user and an outer surface defining a channel configured to receive the strap therein.

Another particular method further includes a step of providing instructions explaining to a user how to attach the attachment device to the handheld vaporizer and/or how to use the attachment device.

A method of providing a handle for attachment to a hand-held vaporizer is also disclosed. The method includes the steps of providing an attachment device defining a handle portion and at least one coupling mechanism, and providing information causing a user to couple the attachment device to the hand-held vaporizer via the at least one coupling mechanism.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a device for attachment to an electronic handheld vaporizer. The attachment device provides a handle for holding and securing the vaporizer to prevent accidental drops and damage. In addition, the attachment device provides a means for attaching other devices (e.g., a lanyard, a carabiner clip, etc.) to the vaporizer. In the following description, numerous specific details are set forth (e.g., electrical terminal designs, material types, vaporizer fluids, dimensions of the device, etc.) in order to provide a thorough understanding of the invention. Those skilled in the art will recognize, however, that the invention may be practiced apart from these specific details. In other instances, details of well-known electronic vaporizer components and control practices (e.g., parts and configurations, heating element actuation input sensors, heating element power control, etc.) have been omitted, so as not to unnecessarily obscure the present invention.

Figure 1:
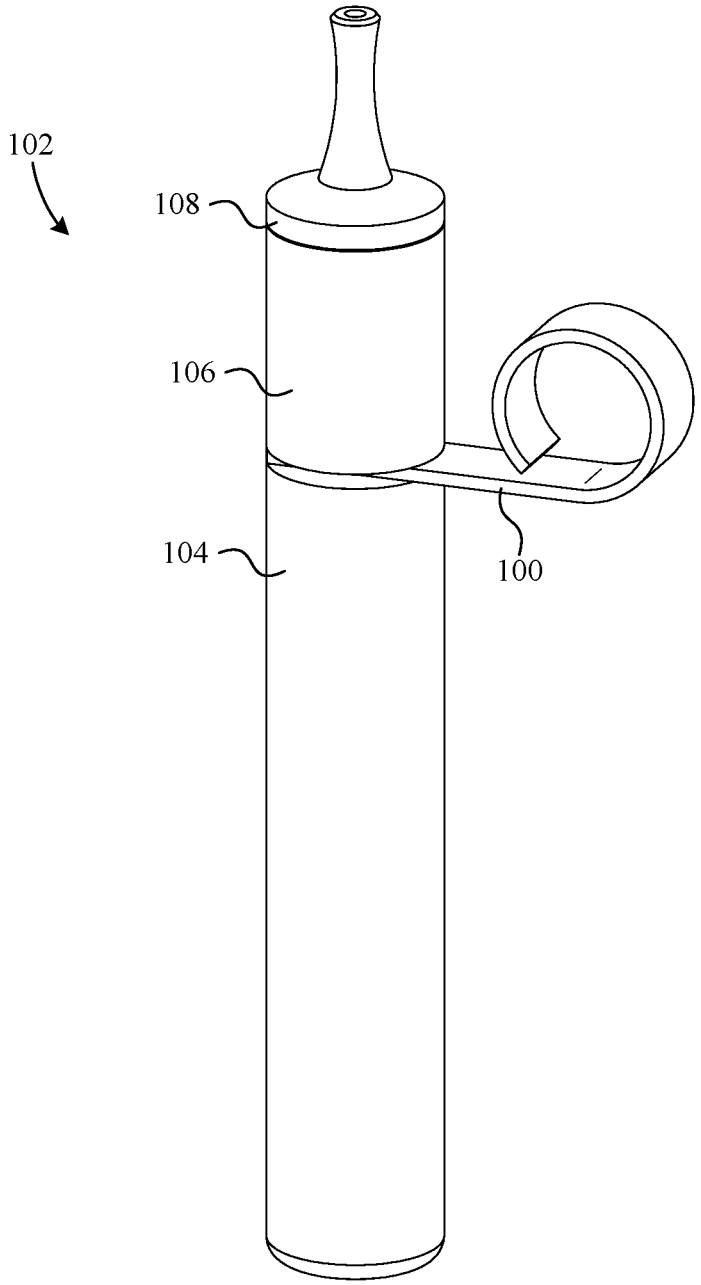
FIG. 1 shows a perspective view of an attachment device according to one embodiment of the present invention mounted on a handheld vaporizer.

FIG. 1 shows a perspective view of an attachment device 100, according to one embodiment of the invention, which is mounted on an electronic handheld vaporizer 102. Device 100 is removably coupled to vaporizer 102 and is adapted to receive at least one finger of a user therethrough when vaporizer 102 is carried by a user. With the user's finger(s) is inserted through the loop in attachment device 100, the user is less likely to drop vaporizer 102. As another advantage, the user is free to use their hands while still holding vaporizer 102. For example, vaporizer 102 can be positioned on a finger of the user and adjacent the back of the user's hand such that the user's hand is free to grip other objects.

As shown in this embodiment, vaporizer 102 includes a battery unit 104, a vaporizing unit 106, a mouthpiece unit 108, and control circuitry (not shown). Battery unit 104 and mouthpiece unit 108 are mechanically attached to opposite ends of vaporizing unit 106. In the example embodiment, attachment device 100 is interposed at the joint between battery unit 104 and vaporizing unit 106. It will be apparent, however, that attachment device 100 can be mounted in various locations and orientations according to user preference. For example, attachment device 100 can be mounted at the joint between mouthpiece unit 108 and vaporizing unit 106.

Figure 2:
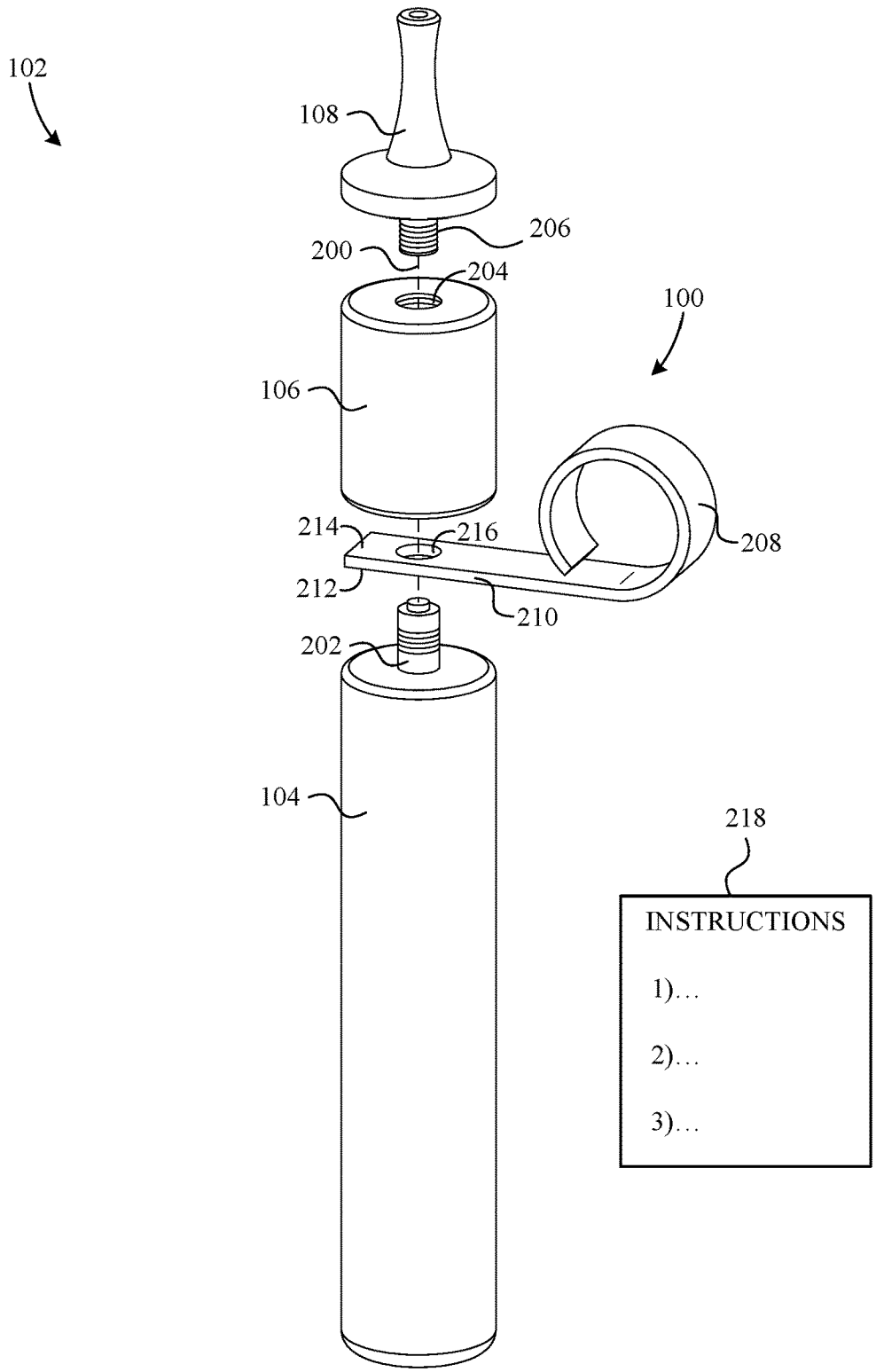
FIG. 2 shows an exploded perspective view of the attachment device and handheld vaporizer of FIG. 1.

FIG. 2 shows an exploded perspective view of attachment device 100 and vaporizer 102 along an axis 200. Battery unit 104 is, for example, a rechargeable battery pack that provides power to vaporizing unit 106 during operation. Battery unit 104 includes a male threaded electrical contact 202 for electrically and mechanically coupling battery unit 104 to vaporizing unit 106.

Although not shown in detail, vaporizing unit 106 includes an atomizer (a heating element in this example) and a fluid reservoir in fluid communication with the atomizer. The fluid reservoir is a refillable tank for storing the fluid that is heated and converted into vapor by the heating element. The heating element is a resistive electrical device that heats up in response to the electrical current supplied by battery unit 104 passing therethrough. The bottom end of vaporizing unit 104 includes a female threaded electrical contact (not shown) that is complementary to male threaded electrical contact 202 of battery unit 104. The complimentary threaded electrical contact of vaporizing unit 106 facilitates the electrical and mechanical coupling of vaporizing unit 106 to battery unit 104. Accordingly, battery unit 104 can be screwed into and out of vaporizing unit 106.

The top end of vaporizing unit 106 includes a threaded port 204 through which the reservoir within vaporizing unit 106 can be filled with vaporizer fluid (e.g., a solution containing propylene glycol, flavor, nicotine, etc.). Port 204 also expels vapor when the heating element of the atomizer is actuated. Port 204 is additionally configured to removably engage a mouthpiece unit 108 so that the vapor expelled out of port 204 can be inhaled by the user. More specifically, mouthpiece unit 108 includes a male threaded tube 206 that is complementary to port 204.

The control circuitry of vaporizer 102 and/or battery unit 104 provides a means for actuating the heating element within vaporizing unit 106 in response to user input. For example, the control circuitry can include a momentary switch that asserts a voltage on the heating element when pressed. Alternatively, the momentary switch can be substituted with a pressure sensor disposed in vaporizing unit 106. In such a case, the control circuitry would actuate the heating element in response to a sensed negative pressure caused by the user inhaling through mouthpiece unit 108. The control circuitry can also include a user interface for controlling settings such as, for example, how hot the heating element gets during actuation. However, those skilled in the art will recognize that details of the control circuitry are not essential elements of the present invention.

Device 100 is shown in further detail to include a finger engaging feature 208 and a coupling feature 210. Finger engaging feature 208 is a loop adapted to receive, and substantially surround, at least one finger of a user when the user is carrying and/or gripping vaporizer 102. It should be recognized that finger engaging feature 208 prevents vaporizer 102 from falling out of the user's hands even when the user's hand is not gripping vaporizer 102. Coupling feature 210 includes a pair of planar surfaces 212 and 214 having an aperture 216 formed therethrough. Planar surfaces 212 and 214 are adapted to frictionally engage battery unit 104 and vaporizing unit 106, respectively, when battery unit 104 and vaporizing unit 106 are attached to one another. Aperture 216 allows threaded electrical contact 202 of battery unit 104 to pass therethrough to engage vaporizing unit 106. The diameter of aperture 216 can be varied according to the diameter and general design of electrical contact 202.

Attachment device 100 can also include instructions 218 for directing and/or explaining to a user how to couple the attachment device 100 to a handheld vaporizer (e.g., vaporizer 102) and/or how to use attachment device 100. Instructions 218 can be coupled with attachment device 100 in various ways. For example, instructions 218 can be affixed to attachment device 100 as a tag, sticker, etc. As another example, instructions 218 can be included as an insert in the packaging containing attachment device 100 and/or on the packaging itself.

In the example embodiment, device 100 is of monolithic construction. That is, finger engaging feature 208 and coupling feature 210 are integrally formed from the same material. For example, attachment device 100 can be manufactured by stamping it from a piece of sheet metal (e.g., stainless steel, etc.) and then bending it to form finger engaging feature 208. Alternatively, device 100 can be manufactured from plastic by a molding process (e.g., injection molding) as a single part having the desired form. Device 100 can also be manufactured in other ways, such as by casting, extrusion, etc.

Figure 3:
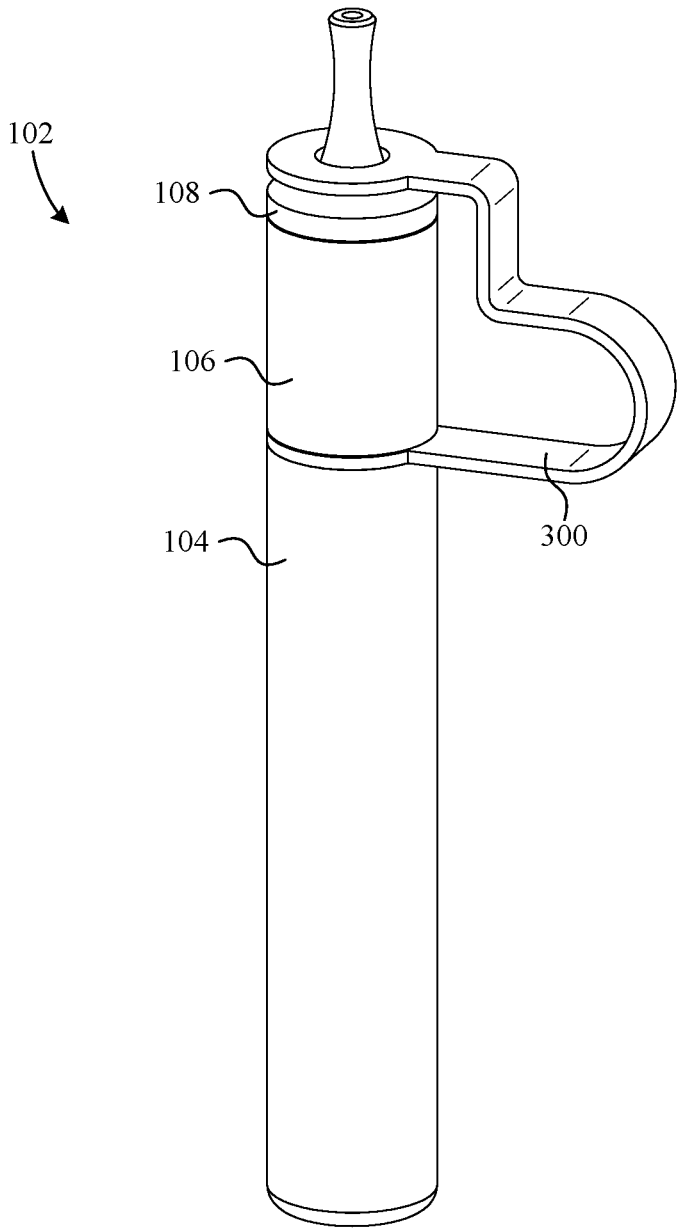
FIG. 3 shows a perspective view of an attachment device according to another embodiment of the present invention mounted on a handheld vaporizer.

FIG. 3 shows a perspective view of an attachment device 300, according to another embodiment of the present invention, which is mounted on electronic handheld vaporizer 102. In this particular embodiment, attachment device 300 is mounted at two points of contact with vaporizer 102. Specifically, device 300 is coupled over mouthpiece unit 108 and at the joint between battery unit 104 and vaporizing unit 106.

Figure 4:
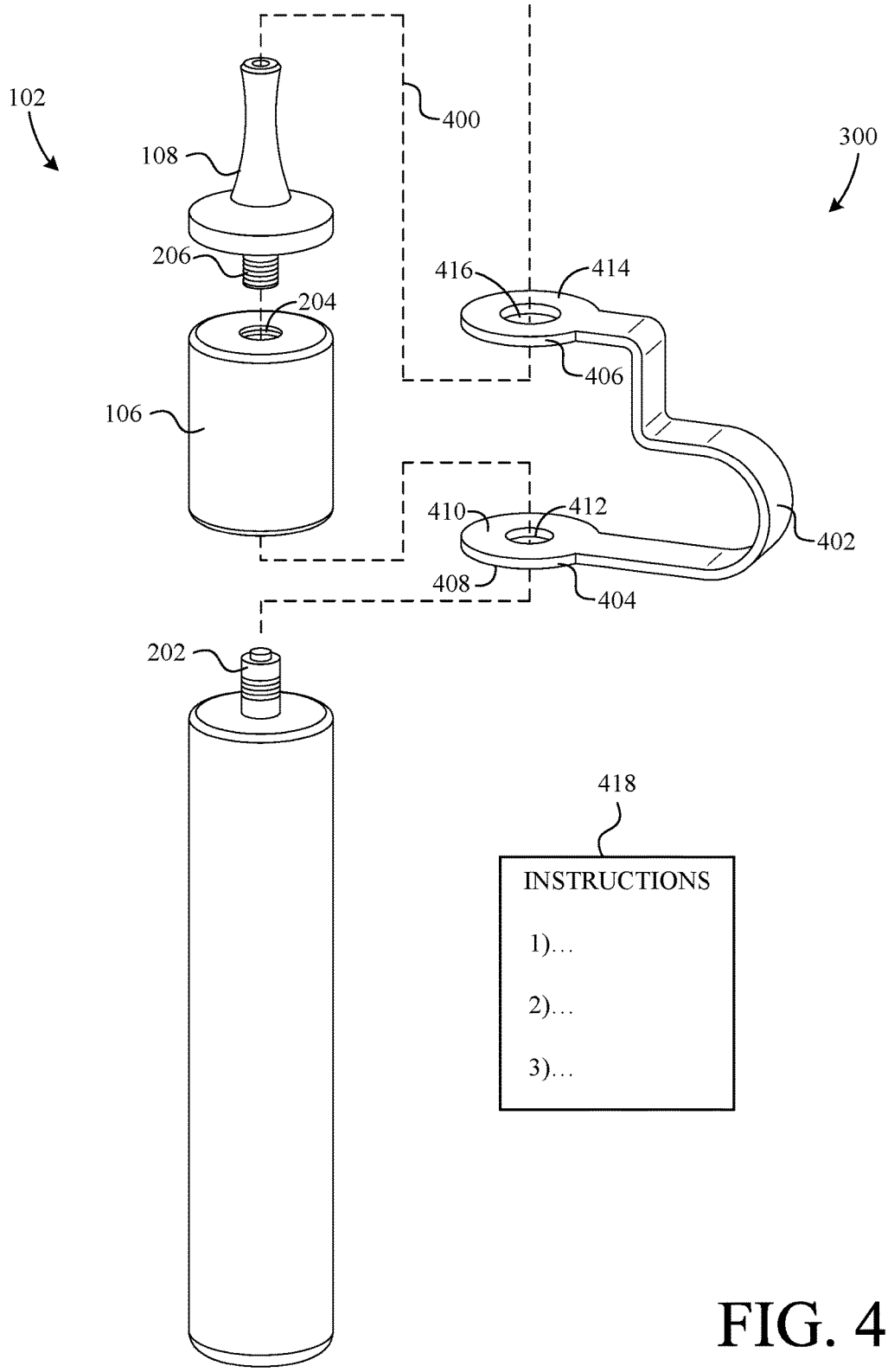
FIG. 4 shows an exploded perspective view of the attachment device and handheld vaporizer of FIG. 3.

FIG. 4 shows attachment device 300 and vaporizer 102 exploded along an axis 400. Attachment device 300 includes a finger engaging feature 402 disposed between a first coupling feature 404 and a second coupling feature 406. Finger engaging feature 402 is adapted to receive, and substantially surround, at least one finger of a user so as to prevent vaporizer 102 from being accidentally dropped. First coupling feature 404 includes a pair of planar surfaces 408 and 410 having an aperture 412 passing therethrough. Planar surfaces 408 and 410 are adapted to frictionally engage battery unit 104 and vaporizing unit 106, respectively, when battery unit 104 and vaporizing unit 106 are attached to one another. Aperture 412 is sized to allow threaded electrical contact 202 to pass therethrough and engage vaporizing unit 106. Coupling feature 406 includes a generally annular region 414 defining an aperture 416 that is adapted (sized) to receive mouthpiece unit 108 therethrough.

Attachment device 300 also includes instructions 418 for coupling attachment device 300 to a handheld vaporizer (e.g., vaporizer 102) and/or for using attachment device 300. Instructions 418 can be coupled with attachment device 300 in various ways as described above with respect to instructions 218.

In the example embodiment, attachment device 300 is of monolithic construction. That is, finger engaging feature 402, first coupling feature 404, and coupling feature 406 are all integrally formed from the same material. For example, device 300 can be stamped from a single piece of sheet metal (e.g., stainless steel, etc.) and then bent into shape. Alternatively, device 300 can be a unitary molded plastic part, cast, extruded, etc.

Figure 5:
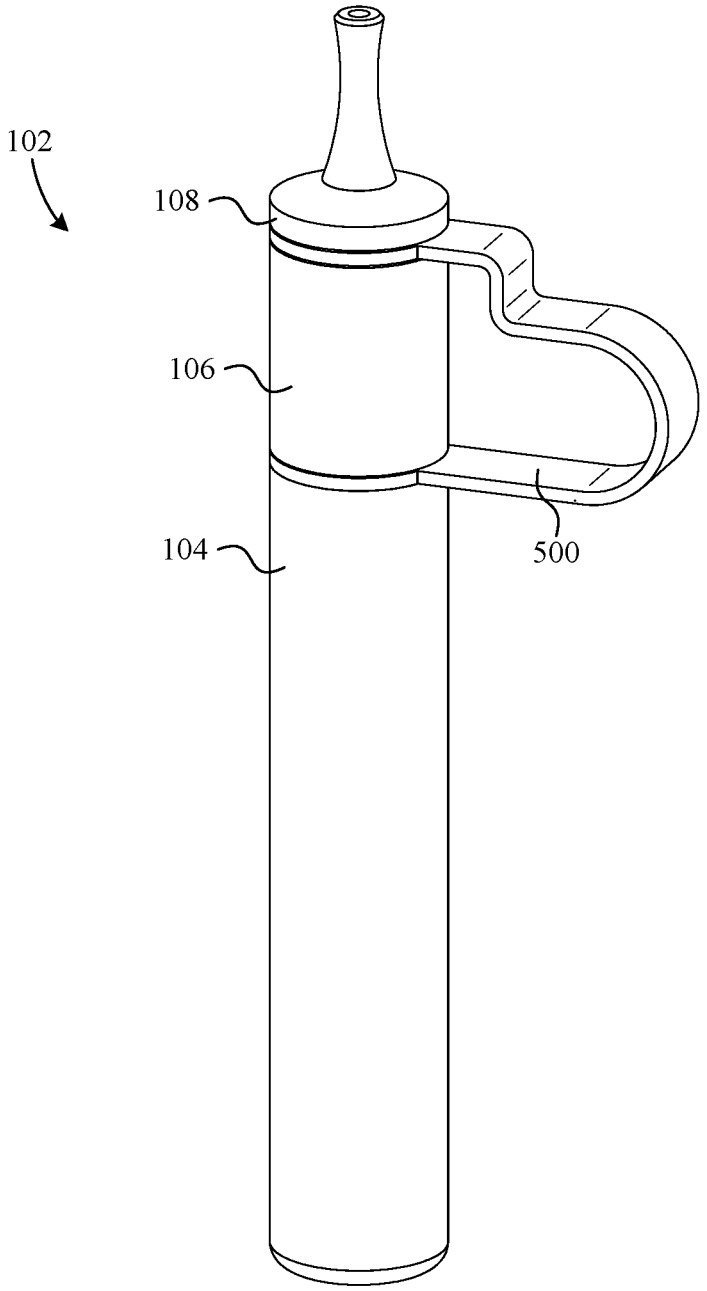
FIG. 5 shows a perspective view of an attachment device according to yet another embodiment of the present invention mounted on a handheld vaporizer.

FIG. 5 shows a perspective view of an attachment device 500, according to yet another embodiment of the present invention, which is mounted on electronic handheld vaporizer 102. In this particular embodiment, attachment device 500 is mounted at two points of contact with vaporizer 102. Specifically, attachment device 500 is coupled at the joint between battery unit 104 and vaporizing unit 106, and at the joint between vaporizing unit 106 and mouthpiece unit 108.

Figure 6:
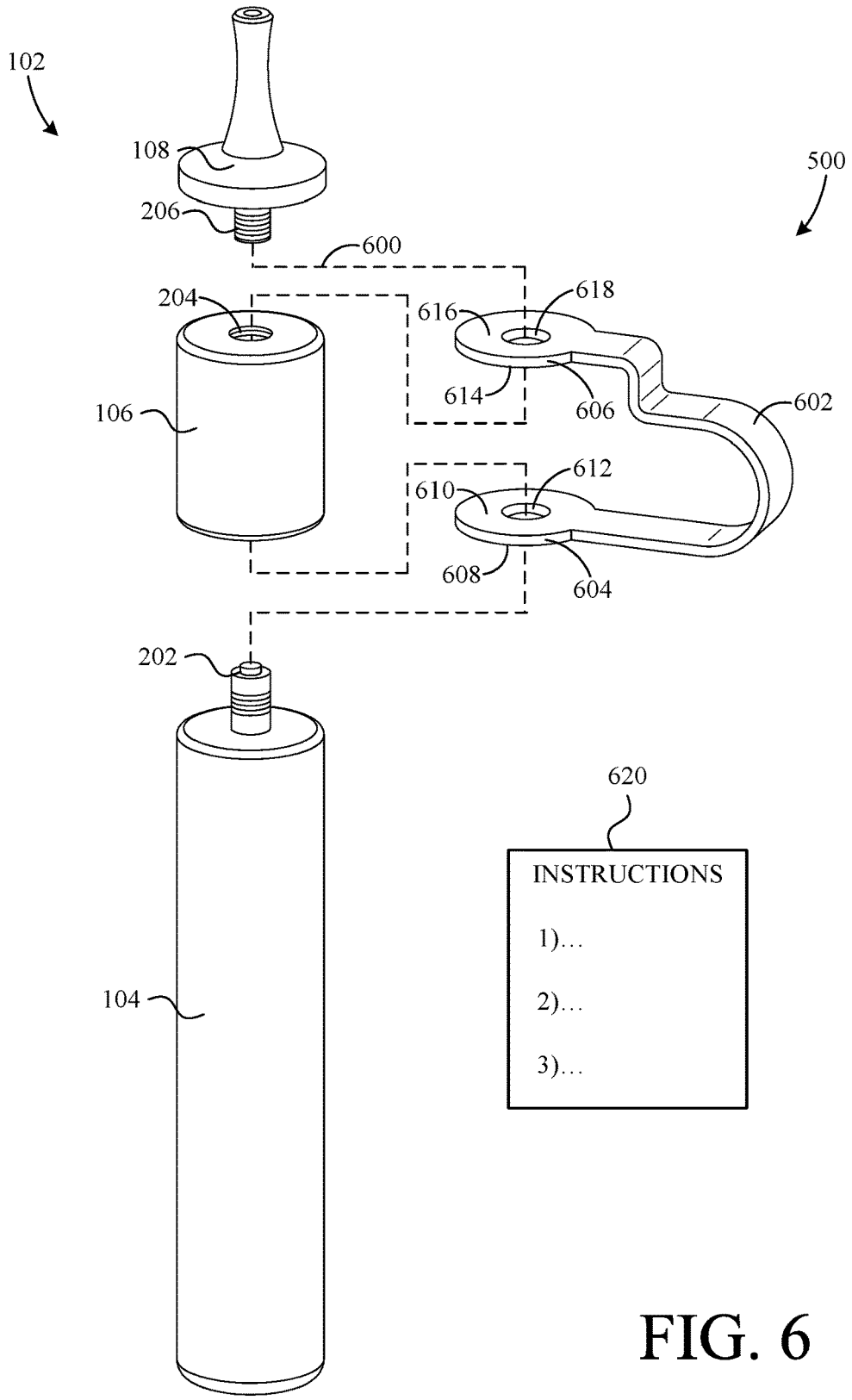
FIG. 6 shows an exploded perspective view of the attachment device and handheld vaporizer of FIG. 5.

FIG. 6 shows attachment device 500 and vaporizer 102 exploded along an axis 600. Device 500 includes a finger engaging feature 602 disposed between a first coupling feature 604 and a second coupling feature 606. Finger engaging feature 602 is adapted to receive, and substantially surround, one or more finger(s) of a user so as to prevent vaporizer 102 from being accidentally dropped. First coupling feature 604 includes a pair of planar surfaces 608 and 610 having an aperture 612 passing perpendicularly therethrough. Planar surfaces 608 and 610 are adapted to frictionally engage battery unit 104 and vaporizing unit 106, respectively, when battery unit 104 and vaporizing unit 106 are attached to one another. The diameter of aperture 612 is sized to allow threaded electrical contact 202 to pass therethrough and engage vaporizing unit 106. Second coupling feature 606 includes a pair of planar surfaces 614 and 616 having an aperture 618 passing perpendicularly therethrough. Planar surfaces 614 and 616 are adapted to frictionally engage vaporizing unit 106 and mouthpiece unit 108, respectively, when vaporizing unit 106 and mouthpiece unit 108 are attached to one another. Aperture 618 is sized to allow tube 206 to pass therethrough and engage vaporizing unit 106.

As in prior embodiments, attachment device 500 includes instructions 620 explaining how to couple attachment device 500 to a handheld vaporizer (e.g., vaporizer 102) and/or how to use attachment device 500. Instructions 620 can be coupled with attachment device 500 in various ways as described above with respect to instructions 218.

As in prior embodiments, device 500 is constructed monolithically. As shown, finger engaging feature 602, first coupling feature 604, and second coupling feature 606 are all integrally formed from the same material (e.g., stainless steel, plastic etc.), for example, by stamping and bending, molding, etc. as discussed above.

Figure 7:
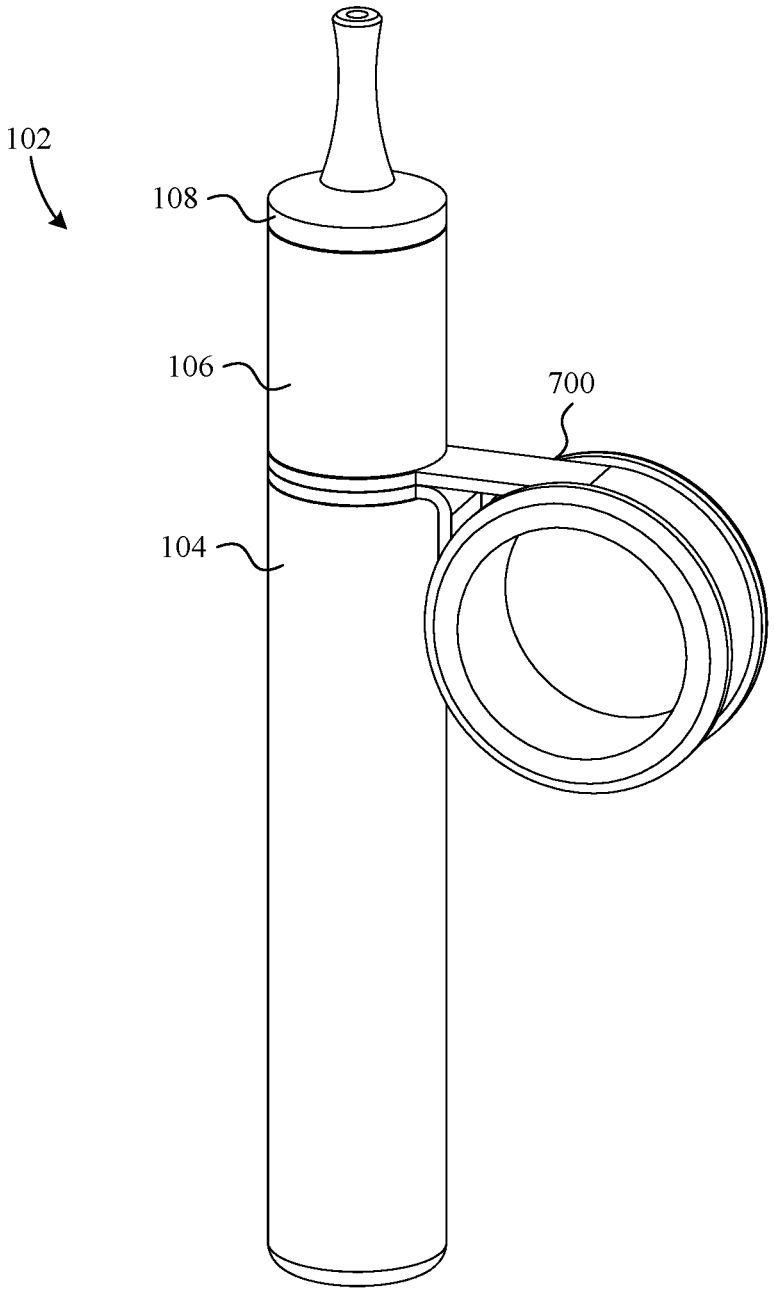
FIG. 7 shows a perspective view of an attachment device according to yet another embodiment of the present invention mounted on a handheld vaporizer.

FIG. 7 shows a perspective view of an attachment device 700, according to still another embodiment of the present invention, which is mounted on electronic handheld vaporizer 102. In this particular embodiment, attachment device 700 is coupled to vaporizer 102 at the joint between battery unit 104 and vaporizing unit 106. However, the user might instead choose to mount device 700 to vaporizer 102 at the joint between vaporizing unit 106 and mouthpiece unit 108.

Figure 8:
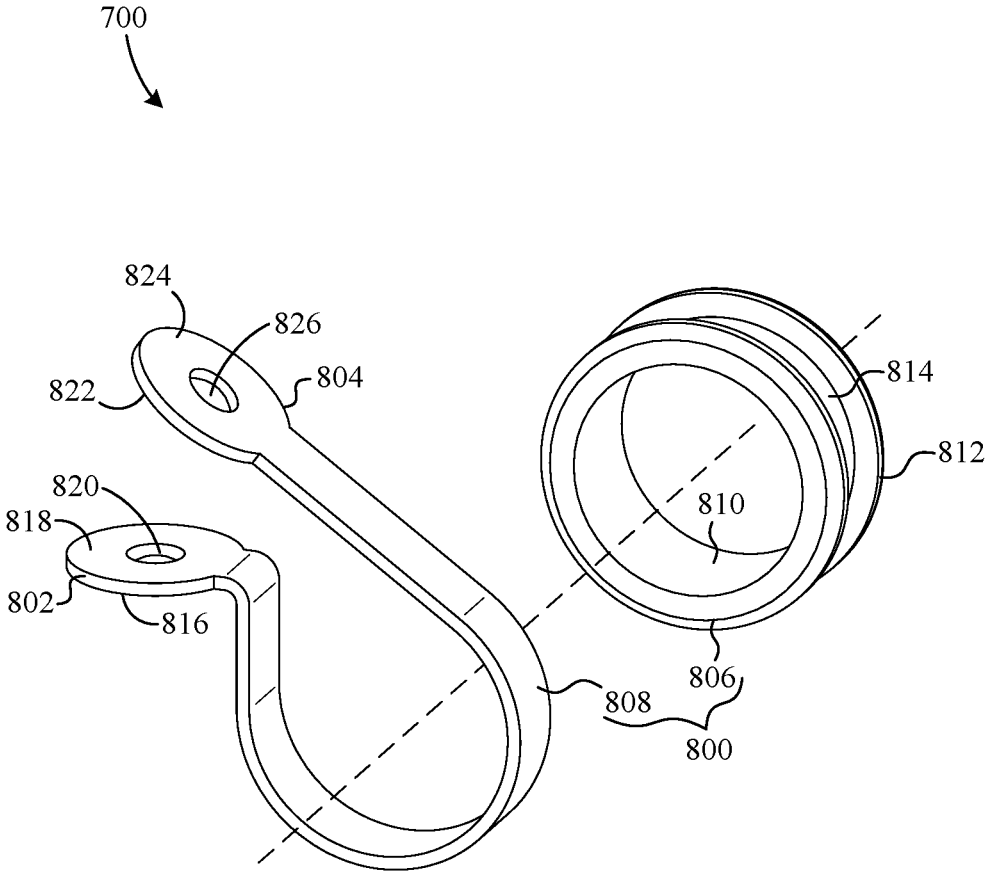
FIG. 8 shows a perspective view of the attachment device of FIG. 7 in a disassembled state.

FIG. 8 shows a perspective view of attachment device 700 in a disassembled state. In the example embodiment, device 700 includes a finger engaging feature 800 disposed between a first coupling feature 802 and a second coupling feature 804. Finger engaging feature 800 includes an annular member 806 and a strap 808. Annular member 806 includes an interior surface 810 and an exterior surface 812 defining a channel 814. Interior surface 810 provides a smooth surface that engages at least one finger of a user. Channel 814 is adapted to seat strap 808 therein, thereby securing annular member 806 when first and second coupling features 802 and 804 are urged toward one another. Coupling feature 802 includes a pair of planar surface 816 and 818 having an aperture 820 passing therethrough. Likewise, second coupling feature 804 includes a pair of planar surfaces 822 and 824 and an aperture 826 passing therethrough. Apertures 820 and 826 are sized to receive threaded electrical contact 202 of battery unit 104 therethrough.

Figure 9:
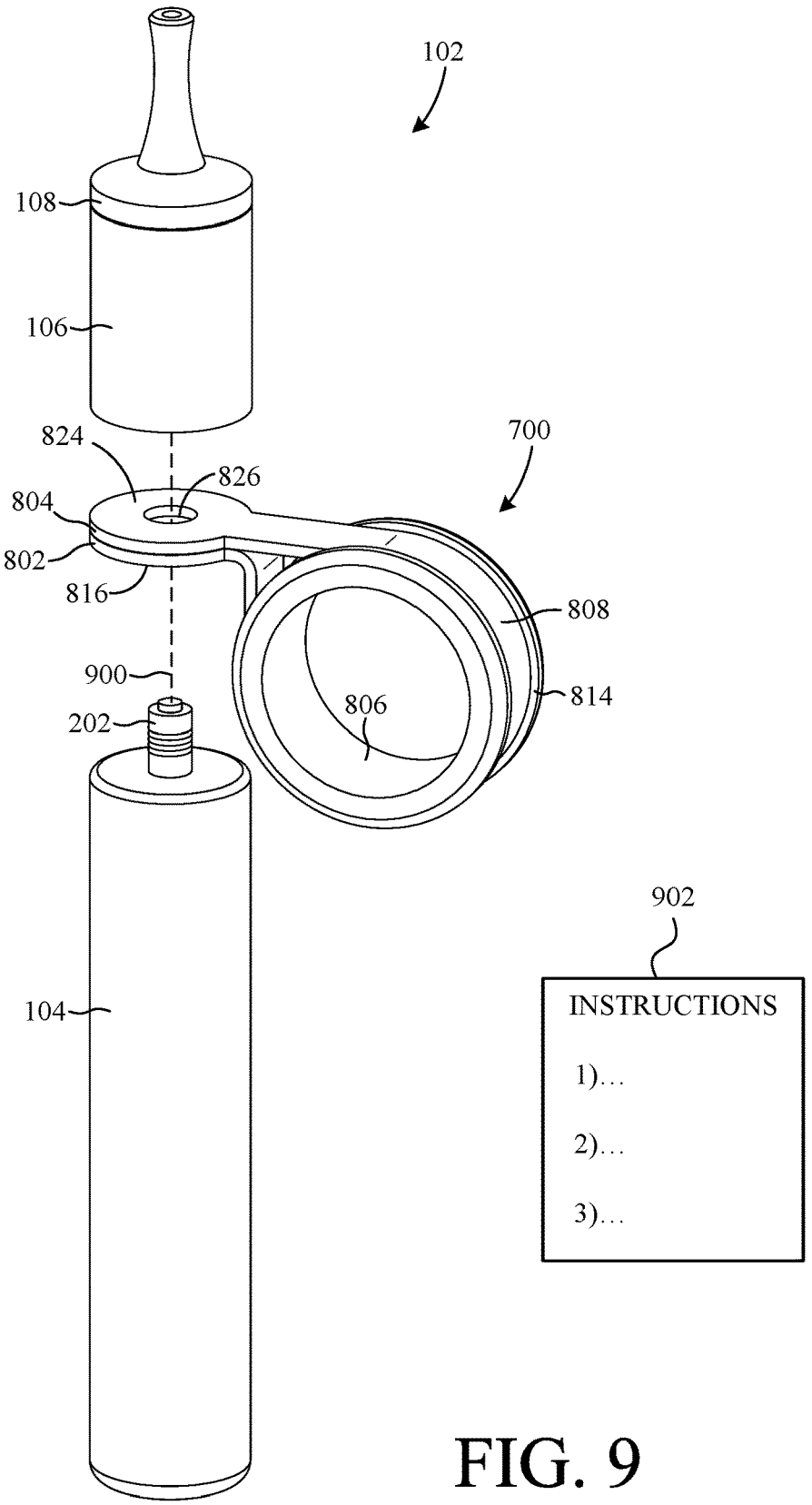
FIG. 9 shows an exploded perspective view of the attachment device and handheld vaporizer of FIG. 7.

FIG. 9 shows a perspective view of attachment device 700 and vaporizer 102 exploded along an axis 900. Attachment device 700 is shown in an assembled position wherein strap 808 is seated in channel 814, and planar surface 818 of first coupling feature 802 is mated against planar surface 822 of second coupling feature 804. During the mounting of device 700 to vaporizer 102, threaded contact 202 is disposed through both apertures 820 and 826. Furthermore, planar surface 816 of first coupling feature 802 and planar surface 824 of second coupling feature 804 are frictionally engaged by battery unit 104 and vaporizing unit 106, respectively.

Optionally, attachment device 700 can instead be mounted at the joint defined by the interface between vaporizing unit 106 and mouthpiece unit 108 wherein tube 206 is disposed through both apertures 820 and 826. In other words, planar surface 816 of first coupling feature 802 and planar surface 824 of second coupling feature 804 are frictionally engaged by vaporizing unit 106 and mouthpiece unit 108, respectively.

As in prior embodiment, attachment device 700 can include instructions 902 explaining to a user how to couple attachment device 700 to a handheld vaporizer (e.g., vaporizer 102) and/or how to use attachment device 700. Instructions 620 can be coupled with attachment device 700 in various ways as described above with respect to instructions 218.

In the present embodiment, first coupling feature 802, second coupling feature 804, and strap 808 are integrally formed from sheet metal, for example, by stamping and bending as in prior embodiments. Forming first and second coupling features 802 and 804 from metal provides the advantage that first and second coupling features 802 and 804 can be made thin, but strong, so that electrical contact 202 can sufficiently engage vaporizing unit 106. In other embodiments, first coupling feature 802, second coupling feature 804, and strap 808 can be formed (e.g., by molding) from a resilient plastic.

Annular member 806 can be formed from metal (e.g., stainless steel, aluminum, etc.), for example, by machining metal tubing, casting annular member 806, etc. As other options, annular member 806 can be molded from plastic, rubber, etc.

As in prior embodiments, attachment device 700 improves the user's grip on vaporizer 102. A further advantage of attachment device 700 is that it mounts to vaporizer 102 at a single attachment point. As a result, the particular style and/or dimensions of vaporizer 102 are less significant, and attachment device 700 can, therefore, be used in combination with a wider variety of different handheld vaporizers. Additionally, attachment device 700 can be flipped upside down from the orientation shown in FIG. 9 for use with vaporizers having battery units that are significantly wider than vaporizing unit 106.

Figure 10:
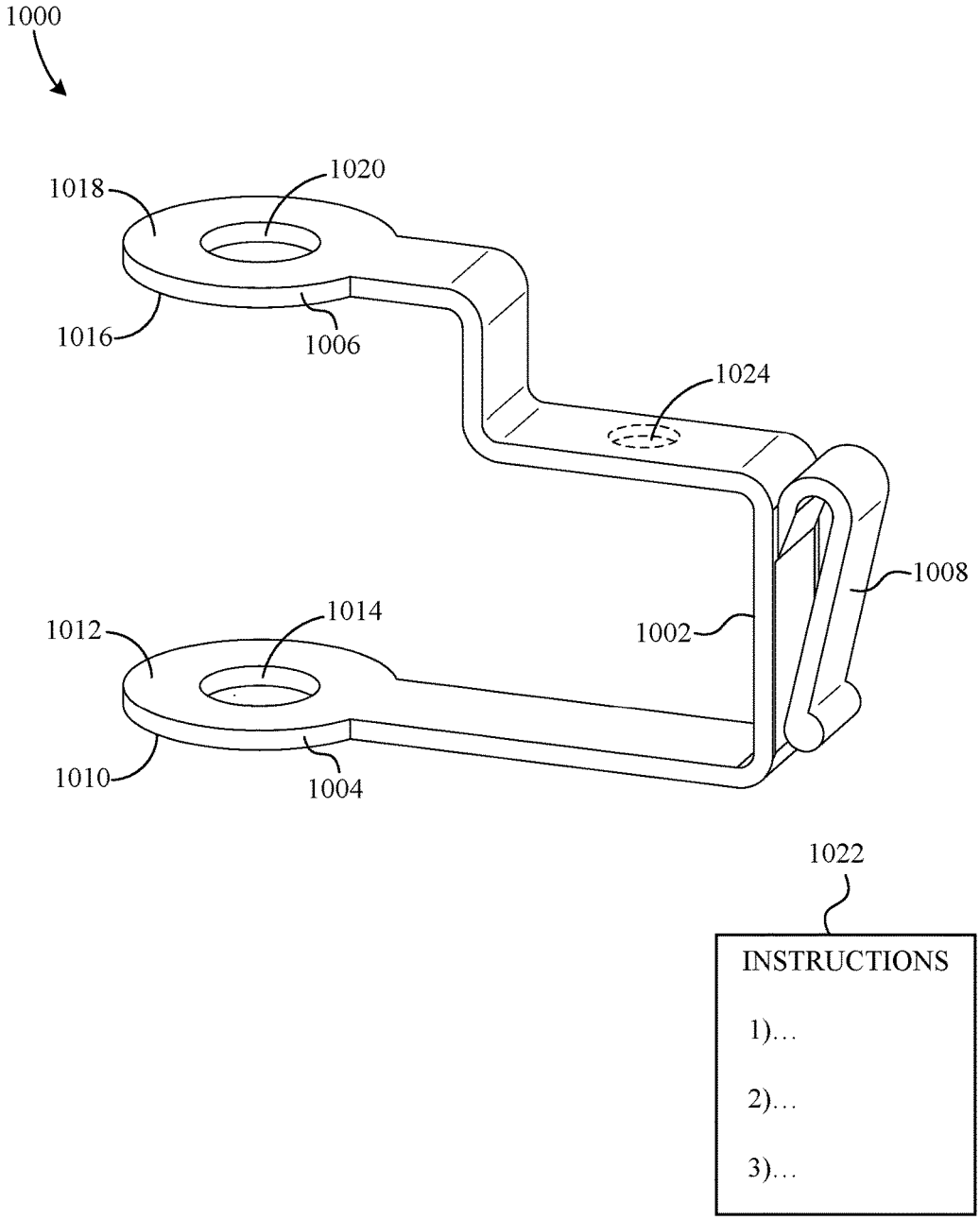
FIG. 10 shows a perspective view of an attachment device according to yet another embodiment of the present invention.

FIG. 10 shows a perspective view of a handheld vaporizer attachment device 1000 according to yet another embodiment of the present invention. Device 1000 includes a finger engaging feature 1002, a first coupling feature 1004, a second coupling feature 1006, and a utility clip 1008. Finger engaging feature 1002 is disposed between first coupling feature 1004 and second coupling feature 1006. Finger engaging feature 1002 is adapted to receive, and substantially surround, at least one finger of a user so as to prevent the attached vaporizer from being dropped.

First coupling feature 1004 includes a pair of planar surfaces 1010 and 1012 having an aperture 1014 passing perpendicularly therethrough. Like first coupling feature 604 of attachment device 500, first coupling feature 1004 is adapted to frictionally engage two surfaces of a joint of a vaporizer. For example, planar surfaces 1010 and 1012 can engage battery unit 104 and vaporizing unit 106 of vaporizer 102, respectively. Second coupling feature 1006 also includes a pair of planar surfaces 1016 and 1018 having an aperture 1020 passing perpendicularly therethrough. Coupling feature 1006 can be adapted to frictionally engage two opposing surfaces of a joint. For example, planar surfaces 1016 and 1018 can engage vaporizing unit 106 and mouthpiece unit 108, respectively. Alternatively, second coupling feature 1006 can be adapted to be positioned directly on (around) a mouthpiece unit (e.g., like coupling feature 406 of FIG. 4).

Utility clip 1008 is coupled to finger engaging feature 1002 and provides a means for coupling attachment device 1000 to another object, for example, a belt, a garment pocket, etc. Utility clip 1008 can also be used to fasten other objects to device 1000. Clip 1008 can be fastened to finger engaging feature 1002 by any suitable means including, but not limited to, adhesive, mechanical fastener(s), welding, and/or integral formation.

As in prior embodiments, attachment device 1000 can include instructions 1022 for coupling attachment device 1000 to a handheld vaporizer (e.g., vaporizer 102) and for using attachment device 1000 and/or utility clip 1008. Instructions 1022 can be coupled with attachment device 700 in various ways as described above with respect to instructions 218.

It should also be noted that the finger engaging features 208, 402, 602, 800, 1002, etc. of the attachment devices described herein themselves provide means for attaching a lanyard, carabiner clip, etc. to a handheld vaporizer when the particular attachment device is coupled to the vaporizer. For example, the lanyard, carabiner clip, etc. can be attached around a portion of the finger engaging feature. As an alternative, the finger engaging feature can include one or more aperture(s), such as aperture 1024 shown in FIG. 10, which is sized and positioned to receive a lanyard, carabiner clip, keyring, etc. therethrough. Aperture(s) providing the function of aperture 1024 can similarly be fashioned in the attachment devices of other embodiments described herein.

FIGS. 11A-11D illustrate an exemplary method of attaching an attachment device 1100 to a handheld vaporizer 1102. Handheld vaporizer 1102 is similar to, but slightly different than, vaporizer 102. More specifically, vaporizer 1102 includes a battery unit 1104, an atomizer 1106, a cartridge 1108, and a mouthpiece unit 1110. Battery unit 104 electrically and physically connects to atomizer 1106 by a threaded coupling 1112, which provides electrical power to atomizer 1106. Atomizer 1106 is further coupled to cartridge 1108 and vaporizes liquid contained in cartridge 1108 by converting electrical energy from battery unit 1104 into heat via a heating element (not shown) when a power switch 1114 is depressed by a user. Vapor created by atomizer 1106 can then be inhaled by a user through mouthpiece unit 1110.

Attachment device 1100 is similar to attachment device 300 (FIGS. 3-4) and includes a first coupling feature 1116 and a second coupling feature 1118, which are connected by an intermediate finger engaging feature 1120. First coupling feature 1116 is similar to first coupling feature 404 of device 300 in that first coupling feature 1116 generally defines a bottom ring (not shown in detail in FIG. 11) that is sized to fit around the threaded electrical coupling of the battery unit. Likewise, second coupling feature 1118 is similar to second coupling feature 406 of device in that second coupling feature 1118 generally defines a top ring (not shown in detail in FIG. 11) that is sized to fit over and around the mouthpiece unit of the vaporizer. As in prior embodiments, finger engaging feature 1120 is designed to accommodate one or more fingers of a user therethrough to provide a more secure grip on vaporizer 1102 once device 1100 is attached thereto.

Attachment device 1100 is provided to the user in combination with instructions 1122 or other information indicating that the attachment device is to be used in combination with a hand-held vaporizer. FIGS. 11A-11D also illustrate how such instructions 1122 can guide a user through the process of installing an attachment device on a vaporizer.

Figure 11A:
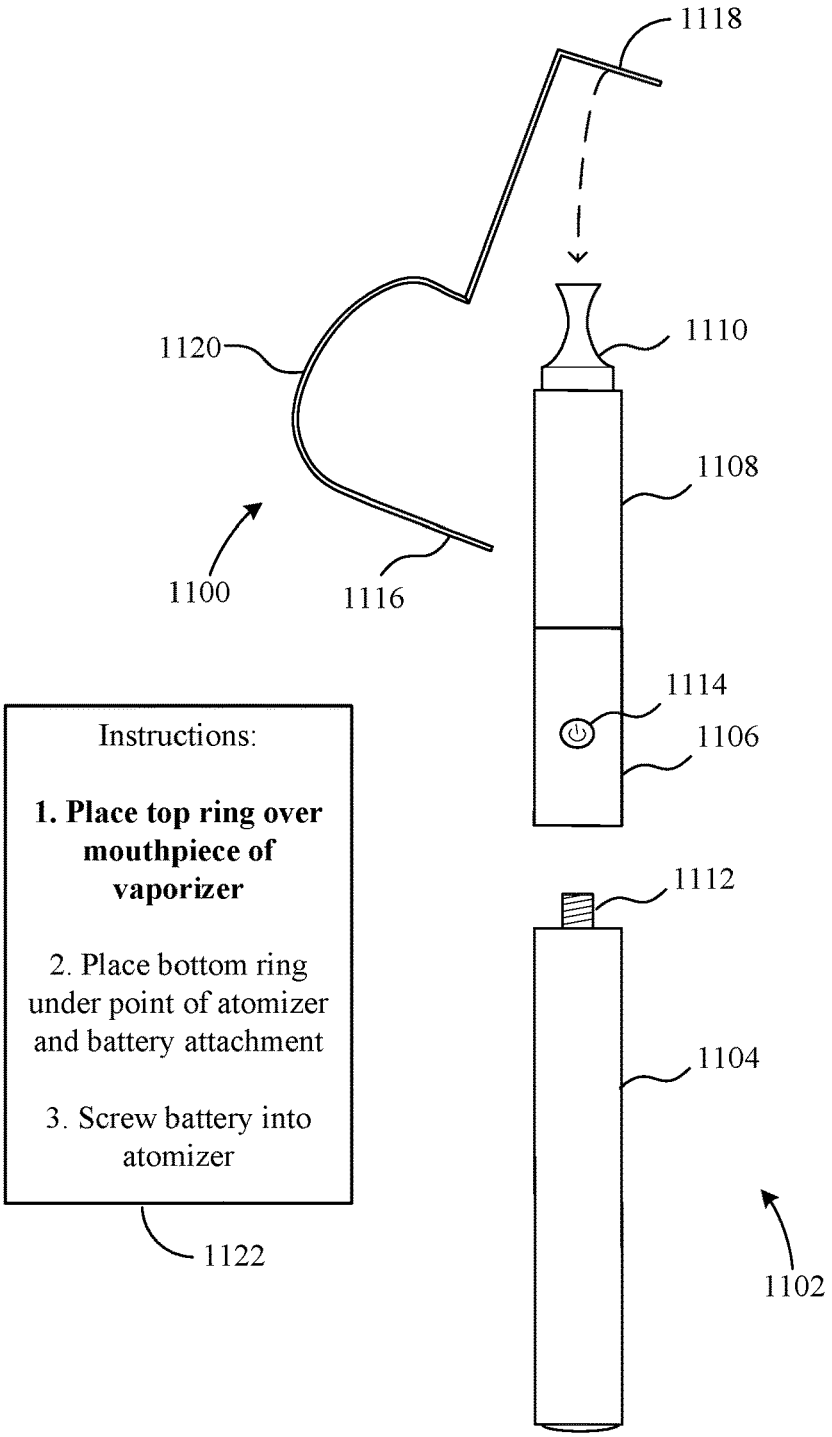
FIGS. 11A-11D illustrate detailed instructions guiding the installation of an attachment device according an exemplary embodiment of the present invention onto a handheld vaporizer.
Figure 11B:
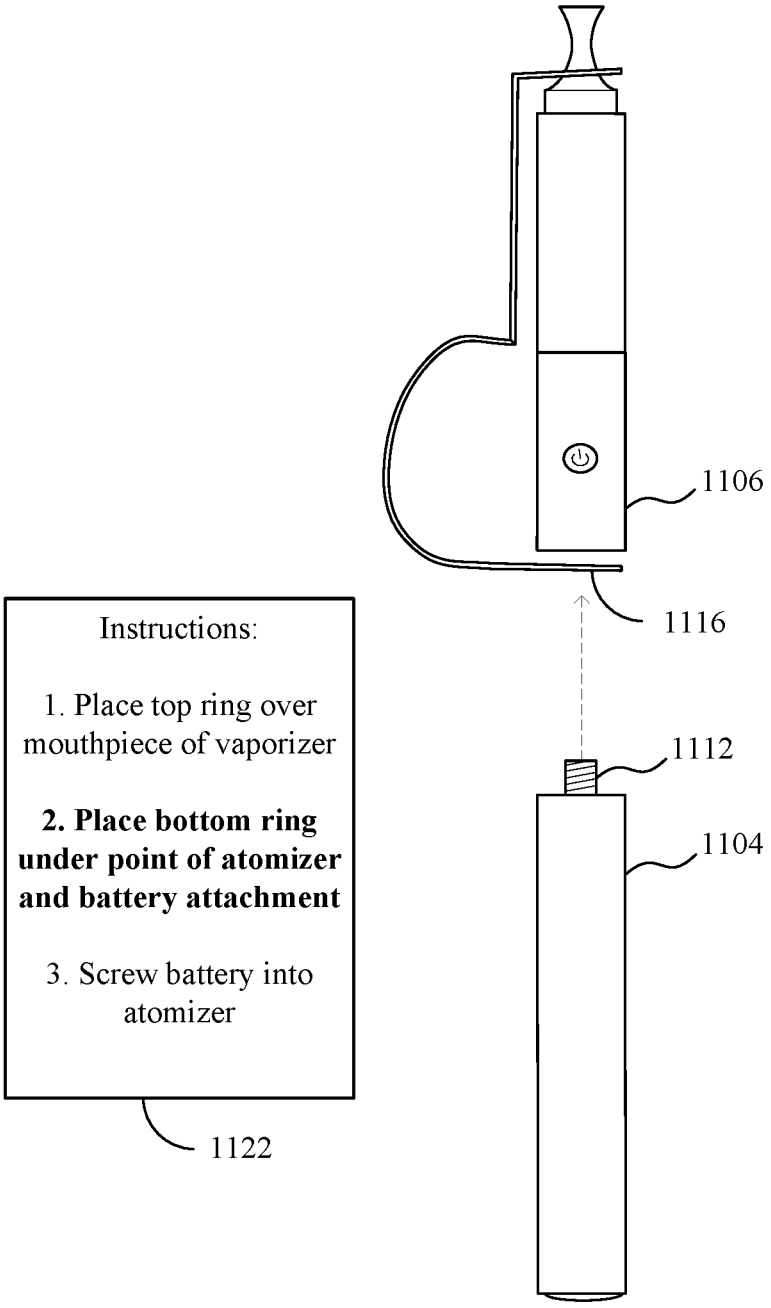
Figure 11C:
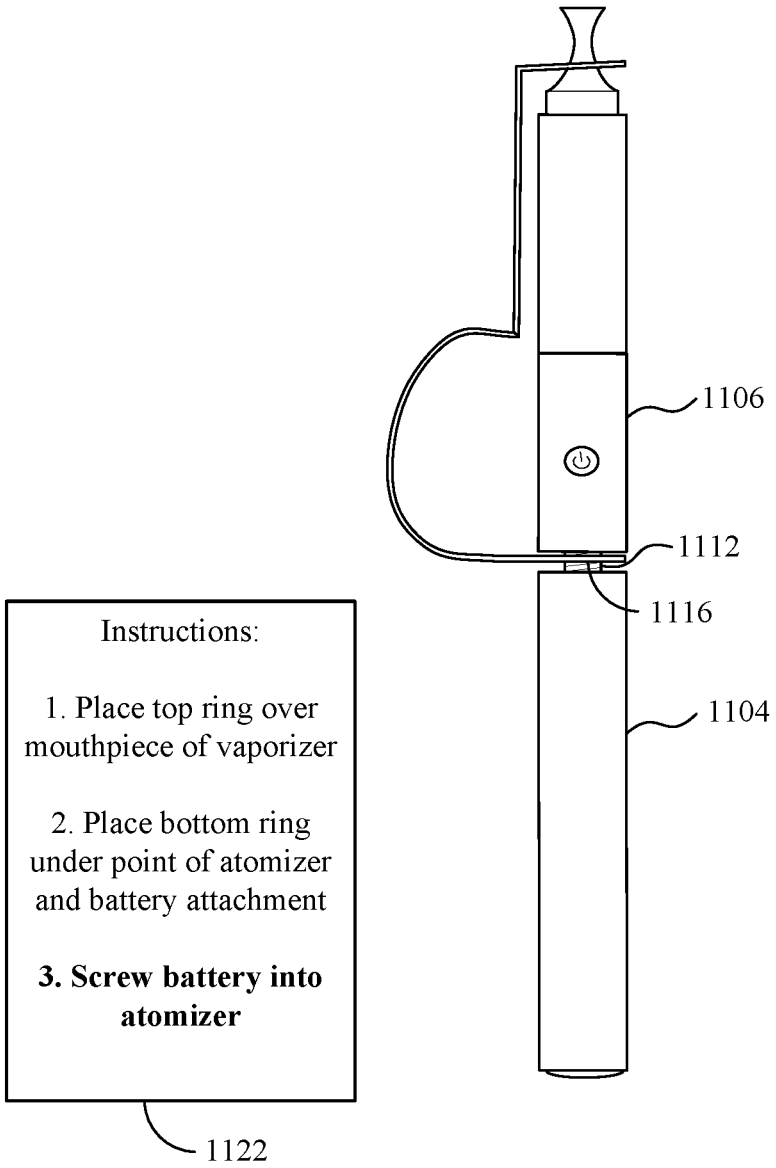
Figure 11D:
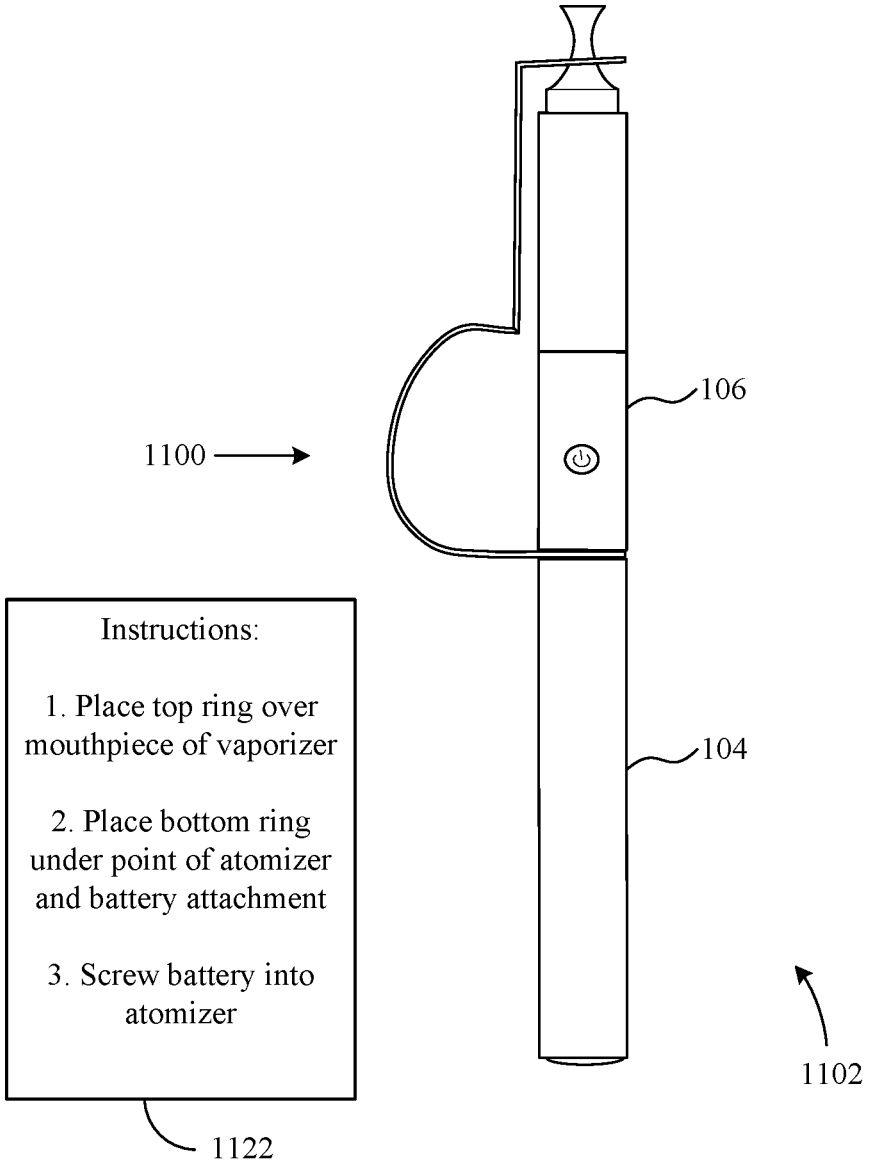

FIG. 11A shows a first step, wherein, as indicated by instructions 1122, the user places top ring 1118 over mouthpiece unit 1110, which is already attached to atomizer 1106 via cartridge 1108. FIG. 11B shows a second step, wherein the user, following a second step in instructions 1122, places lower ring 1116 underneath the portion of atomizer 1106 that accepts threaded coupling 1112. FIG. 11C shows a third step, wherein the user, following a third step in instructions 1122, screws battery 1104 into atomizer 1106 by passing threaded coupling 1112 through lower ring 1116 and threading threaded coupling 1112 into a complimentary thread set of atomizer 1106. FIG. 11D shows vaporizer 1102 and attachment device 1100 after assembly according to instructions 1122. Battery unit 1104 is screwed tightly into atomizer 1106 and attachment device 1100 is held firmly in place by friction.

Detailed instructions can similarly be provided for installing the other attachment devices discussed above on vaporizers, but modified according to the embodiment of attachment device. Additionally, step-wise graphical instructions can be provided instead of written instructions.

Figure 12:
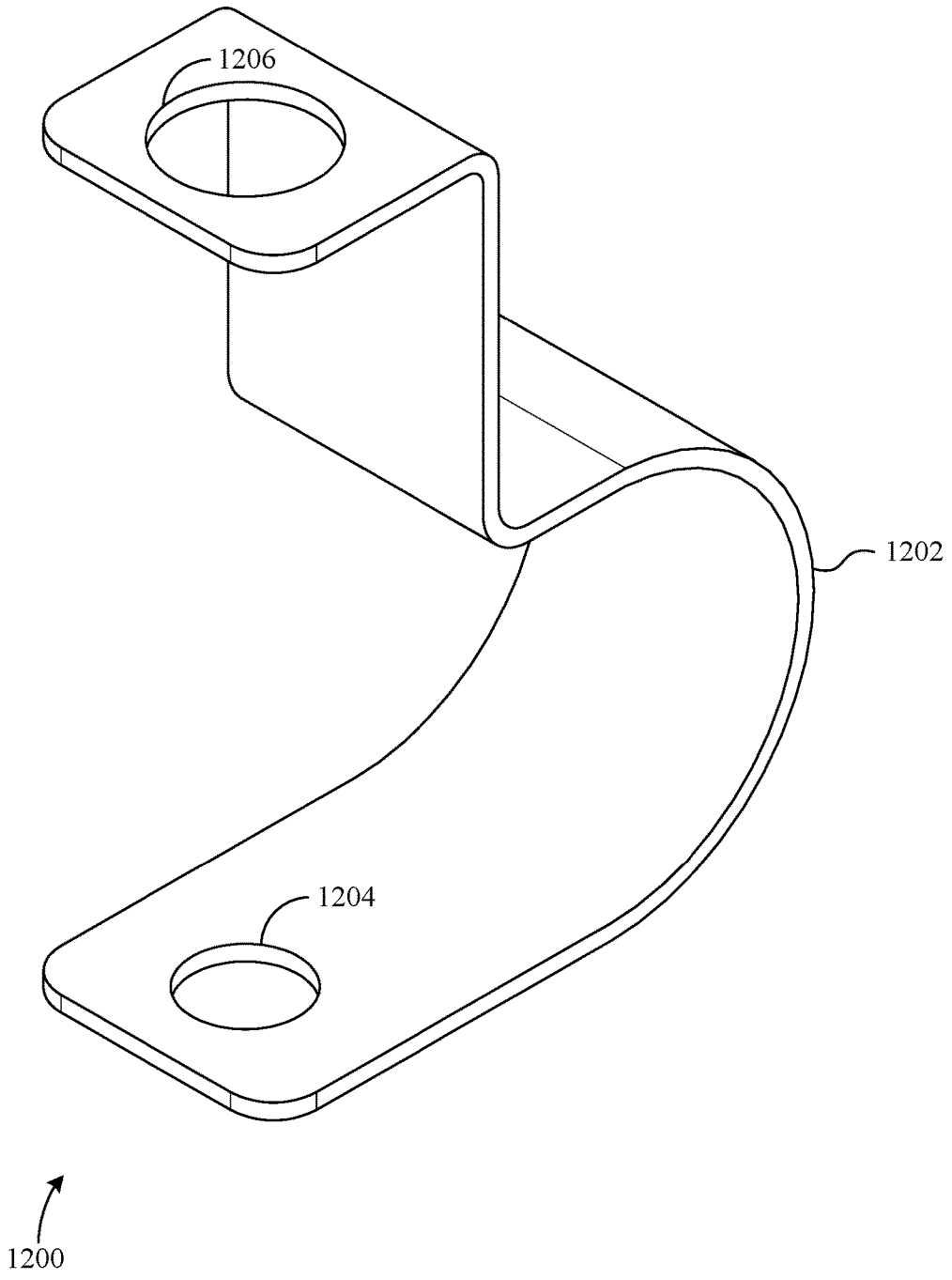
FIG. 12 is a perspective view of yet another embodiment of a handheld vaporizer attachment device according to the present invention.

FIG. 12 shows yet another exemplary attachment device 1200 according to the invention. Attachment device 1200 includes a finger engaging feature 1202, a first coupling feature 1204, and a second coupling feature 1206. Finger engaging feature 1202 is adapted to receive one or more fingers of a user therethrough. Second coupling feature 1206, which is intended for placement over a mouthpiece unit of a handheld vaporizer, is shown to have a larger diameter than first coupling feature 1204, which is intended to fit over a threaded member (e.g., of a battery unit) between vaporizer parts. Thus, attachment device 1200 attaches to a handheld vaporizer in the same manner as attachment device 300 (FIGS. 3-4). However, attachment device 1200 is further shown to have a constant width along its entire length. As in prior embodiments, attachment device 1200 can include instructions for attachment and use with a handheld vaporizer. Attachment device 1200 can also be manufactured using methods described above.

In summary the attachment devices of the present invention provide the advantage of improving a user's grip on the attached handheld vaporizer, which reduces the chances of accidentally dropping and damaging the vaporizer. Additionally, the attachment devices of the invention allow the user flexibility in how to carry the vaporizer, such as by attaching the vaporizer to a lanyard, carabiner clip, belt, pocket, etc. The attachment devices of the invention are also manufacturable in a wide range of sizes and configurations to accommodate various vaporizer designs, or can even be custom made.

Figure 13:
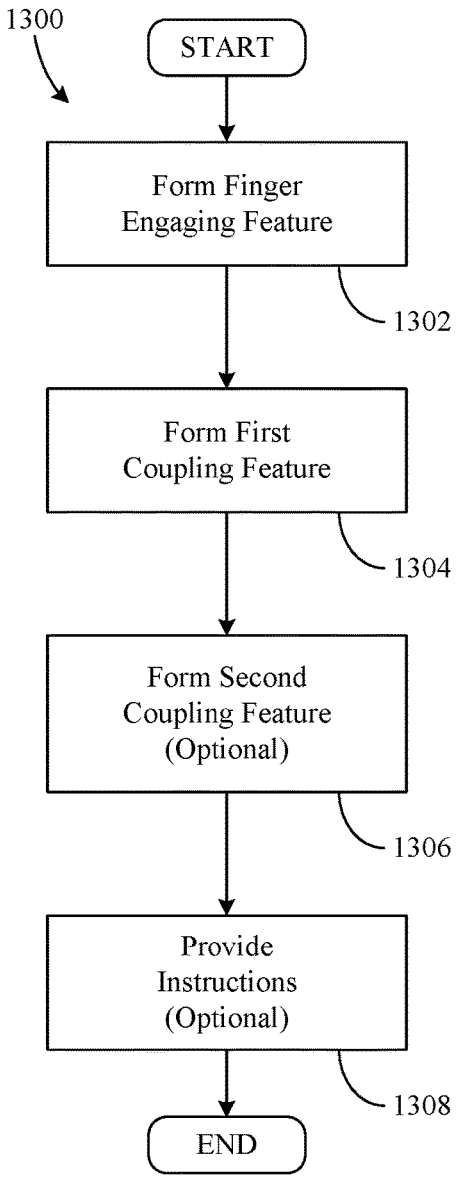
FIG. 13 is a flowchart summarizing a method of manufacturing a handheld vaporizer attachment device according to the invention.

FIG. 13 is a flowchart summarizing a method 1300 of manufacturing an attachment device for a handheld vaporizer according to the present invention. In a first step 1302, a finger engaging feature adapted to engage at least one finger of a user is formed. In a second step 1304, a first coupling feature is formed, where the first coupling feature is disposed to couple the attachment device to the handheld vaporizer. In an optional third step 1306, a second coupling feature is formed and is disposed to couple the attachment device to the handheld vaporizer. In an optional fourth step 1308, instructions are provided explaining to a user how to attach the attachment device to the handheld vaporizer and/or how to use the attachment device with a vaporizer.

Figure 14:
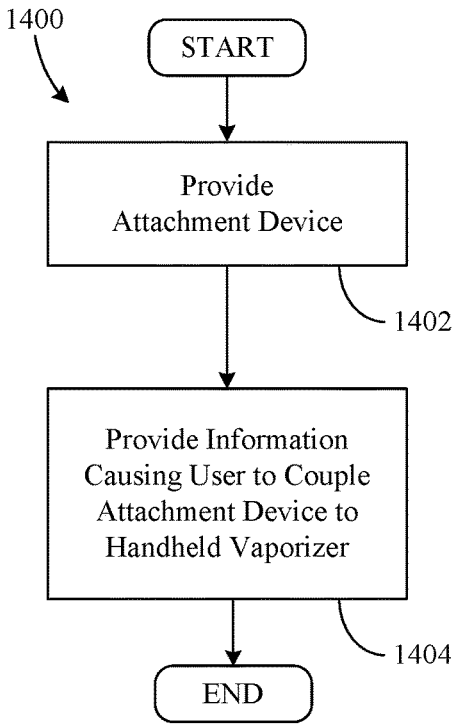
FIG. 14 is a flowchart summarizing a method of providing a handle for attachment to a hand-held vaporizer.

FIG. 14 is a flowchart summarizing a method 1400 of providing a handle for attachment to a hand-held vaporizer. In a first step 1402, an attachment device is provided that defines a handle portion and at least one coupling mechanism. In a second step 1404, information is provided that causes a user to couple the attachment device to the handheld vaporizer via the at least one coupling mechanism.

The description of particular embodiments of the present invention is now complete. Many of the described features may be substituted, altered or omitted without departing from the scope of the invention. For example, alternative shapes (e.g., square, pinched, multiple, etc.) of coupling features may be implemented. As another example, alternative coupling features such as clips, hooks, deformable structure(s) that hold the device in place via a restoring force, etc. may be used. As still another example, the finger engaging features can be designed to fit a plurality of fingers. As yet another example, a friction material can be applied to the finger engaging features described herein to improve grip even further. These and other deviations from the particular embodiments shown will be apparent to those skilled in the art, particularly in view of the foregoing disclosure.

I claim:

1. An attachment device for coupling to an electronic handheld vaporizer, said attachment device comprising:

a finger engaging feature adapted to engage at least one finger of a user; and a first coupling feature disposed to couple said attachment device to said handheld vaporizer; and wherein said first coupling feature includes a first planar surface defining an aperture passing therethrough; and said aperture is adapted to receive a portion of at least one of a battery unit, a vaporizing unit, and a mouthpiece unit of said handheld vaporizer therethrough.

2. The attachment device of claim 1, wherein said first planar surface is adapted to frictionally engage said vaporizing unit of said handheld vaporizer.

3. The attachment device of claim 2, wherein:

said first coupling feature includes a second planar surface opposite said first planar surface, said aperture passing through said second planar surface; and said second planar surface is adapted to frictionally engage said battery unit of said handheld vaporizer.

4. The attachment device of claim 2, wherein:

said first coupling feature includes a second planar surface opposite said first planar surface, said aperture passing through said second planar surface; and said second planar surface is adapted to frictionally engage said mouthpiece unit of said handheld vaporizer.

5. The attachment device of claim 1, further comprising:

a second coupling feature disposed to couple said attachment device to said handheld vaporizer; and wherein said first coupling feature is disposed at a first end of said finger engaging feature; and said second coupling feature is disposed at a second end of said finger engaging feature.

6. The attachment device of claim 5, wherein said first coupling feature is adapted to frictionally engage a battery unit of said handheld vaporizer.

7. The attachment device of claim 6, wherein said second coupling feature is adapted to engage a mouthpiece unit of said handheld vaporizer.

8. The attachment device of claim 6, wherein said second coupling feature is adapted to engage a vaporizing unit of said handheld vaporizer.

9. The attachment device of claim 8, wherein said first coupling feature is adapted to frictionally engage both said battery unit and said vaporizing unit of said handheld vaporizer; and said second coupling feature is adapted to frictionally engage both a mouthpiece unit and said vaporizing unit of handheld vaporizer.

10. The attachment device of claim 9, wherein:

said second coupling feature is generally planar and defines a second aperture passing therethrough; and said first aperture and said second aperture are coaxially aligned with respect to one another when said attachment device is attached to said handheld vaporizer.

11. The attachment device of claim 5, wherein:

said second coupling feature is generally planar and includes a top surface, a bottom surface, and an aperture passing through said top surface and said bottom surface of said second coupling feature; and said planar surface of said first coupling feature and said bottom surface of said second coupling feature are adapted to abut one another, said aperture of said first coupling feature and said aperture of said second coupling feature being coaxially aligned with respect to one another when said planar surface of said first coupling feature abuts said bottom surface of said second coupling feature.

12. The attachment device of claim 11, further comprising:

a generally annular member having an inner surface adapted to engage a finger and an outer surface; and wherein said finger engaging feature includes a strap having a first end coupled to said first coupling feature and a second end coupled to said second coupling feature, said strap configured to secure said annular member.

13. The attachment device of claim 12, wherein said outer surface of said generally annular member defines a channel configured to receive said strap therein.

14. The attachment device of claim 1, further comprising a utility clip.

15. The attachment device of claim 1, wherein said finger engaging feature and said first coupling feature are integrally formed.

16. The attachment device of claim 1, further comprising instructions explaining to a user how to attach said attachment device to said handheld vaporizer.

17. A method of manufacturing an attachment device configured to engage an electronic handheld vaporizer, said method comprising:

forming a finger engaging feature adapted to engage at least one finger of a user; and forming a first coupling feature disposed to couple said attachment device to said handheld vaporizer;

forming a second coupling feature disposed to couple said attachment device to said handheld vaporizer; and wherein said first coupling feature is formed at a first end of said finger engaging feature; and said second coupling feature is formed at a second end of said finger engaging feature.

18. The method of claim 17, wherein said step of forming said finger engaging feature includes:

providing a strap having a first end coupled to said first coupling feature and a second end coupled to said second coupling feature; and providing a generally annular member having an inner surface adapted to engage said at least one finger of said user and an outer surface defining a channel configured to receive said strap therein.

19. The method of claim 17, further comprising providing instructions explaining to a user how to attach said attachment device to said handheld vaporizer.

20. An attachment device for coupling to an electronic handheld vaporizer, said attachment device comprising:

a finger engaging feature adapted to engage at least one finger of a user; and a first coupling feature disposed to couple said attachment device to said handheld vaporizer;

a second coupling feature disposed to couple said attachment device to said handheld vaporizer; and wherein said first coupling feature is disposed at a first end of said finger engaging feature; and said second coupling feature is disposed at a second end of said finger engaging feature.

21. The attachment device of claim 20, wherein:

said first coupling feature includes a first planar surface defining an aperture passing therethrough; and said aperture is adapted to receive a portion of at least one of a battery unit, a vaporizing unit, and a mouthpiece unit of said handheld vaporizer therethrough said first planar surface is adapted to frictionally engage said vaporizing unit of said handheld vaporizer.

22. The attachment device of claim 21, wherein:

said first coupling feature includes a second planar surface opposite said first planar surface, said aperture passing through said second planar surface; and said second planar surface is adapted to frictionally engage said battery unit of said handheld vaporizer.

23. The attachment device of claim 21, wherein:

said first coupling feature includes a second planar surface opposite said first planar surface, said aperture passing through said second planar surface; and said second planar surface is adapted to frictionally engage said mouthpiece unit of said handheld vaporizer.

24. The attachment device of claim 20, wherein said first coupling feature is adapted to frictionally engage a battery unit of said handheld vaporizer.

25. The attachment device of claim 24, wherein said second coupling feature is adapted to engage a mouthpiece unit of said handheld vaporizer.

26. The attachment device of claim 24, wherein said second coupling feature is adapted to engage a vaporizing unit of said handheld vaporizer.

27. The attachment device of claim 26, wherein said first coupling feature is adapted to frictionally engage both said battery unit and said vaporizing unit of said handheld vaporizer; and said second coupling feature is adapted to frictionally engage both a mouthpiece unit and said vaporizing unit of handheld vaporizer.

28. The attachment device of claim 27, wherein:

said first coupling feature is generally planar and defines a first aperture passing therethrough;

said second coupling feature is generally planar and defines a second aperture passing therethrough; and said first aperture and said second aperture are coaxially aligned with respect to one another when said attachment device is attached to said handheld vaporizer.

29. The attachment device of claim 20, wherein:

said first coupling feature is generally planar and includes a top surface, a bottom surface, and an aperture passing through said top surface and said bottom surface of said first coupling feature;

said second coupling feature is generally planar and includes a top surface, a bottom surface, and an aperture passing through said top surface and said bottom surface of said second coupling feature; and said top surface of said first coupling feature and said bottom surface of said second coupling feature are adapted to engage one another, said aperture of said first coupling feature and said aperture of said second coupling feature being coaxially aligned with respect to one another when said top surface of said first coupling feature engages said bottom surface of said second coupling feature.

30. The attachment device of claim 29, further comprising:

a generally annular member having an inner surface adapted to engage a finger and an outer surface; and wherein said finger engaging feature includes a strap having a first end coupled to said first coupling feature and a second end coupled to said second coupling feature, said strap configured to secure said annular member.

31. The attachment device of claim 30, wherein said outer surface of said generally annular member defines a channel configured to receive said strap therein.

32. The attachment device of claim 20, further comprising a utility clip.

33. The attachment device of claim 20, wherein said finger engaging feature and said first coupling feature are integrally formed.

34. The attachment device of claim 20, further comprising instructions explaining to a user how to attach said attachment device to said handheld vaporizer.

35. A method of manufacturing an attachment device configured to engage an electronic handheld vaporizer, said method comprising:

forming a finger engaging feature adapted to engage at least one finger of a user;

forming a first coupling feature disposed to couple said attachment device to said handheld vaporizer; and wherein said first coupling feature includes a first planar surface defining an aperture adapted to receive a portion of at least one of a battery unit, a vaporizing unit, and a mouthpiece unit of said handheld vaporizer therethrough.

* * * * *